US006467652B2

(12) United States Patent
Wilcox et al.

(10) Patent No.: US 6,467,652 B2
(45) Date of Patent: Oct. 22, 2002

(54) DISCHARGE OF PUMPABLE MATERIAL FROM SHIPPER BAGS

(75) Inventors: Donald E. Wilcox, Rochester; William E. Wheeler, Sodus, both of NY (US)

(73) Assignee: A. R. Arena Products, Inc., Rochester, NY (US)

( * ) Notice: Subject to any disclaimer, the term of this patent is extended or adjusted under 35 U.S.C. 154(b) by 0 days.

(21) Appl. No.: 10/039,140

(22) Filed: Jan. 2, 2002

(65) Prior Publication Data

US 2002/0056725 A1 May 16, 2002

Related U.S. Application Data

(63) Continuation-in-part of application No. 09/765,176, filed on Jan. 18, 2001, which is a continuation-in-part of application No. 09/237,819, filed on Jan. 27, 1999, now Pat. No. 6,234,351.

(60) Provisional application No. 60/072,815, filed on Jan. 28, 1998, and provisional application No. 60/072,816, filed on Jan. 28, 1998.

(51) Int. Cl.[7] ..... B65D 35/28

(52) U.S. Cl. ..... 222/95; 222/386.5; 222/389; 383/3; 383/41; 383/109

(58) Field of Search ..... 222/95, 386.5, 222/389, 105; 383/3, 41, 109, 67, 906, 1

(56) References Cited

U.S. PATENT DOCUMENTS

| | | | | |
|---|---|---|---|---|
| 4,548,321 A | | 10/1985 | Mockesch et al. | 206/525 |
| 4,796,788 A | | 1/1989 | Bond | 222/94 |
| 6,234,351 B1 | * | 5/2001 | Wilcox | 222/95 |

FOREIGN PATENT DOCUMENTS

| | | |
|---|---|---|
| EP | 0 098 322 A | 1/1984 |
| FR | 2 316 151 A | 1/1977 |
| FR | 2 375 113 A | 7/1978 |
| WO | WO 82 03838 A | 11/1982 |

* cited by examiner

*Primary Examiner*—Philippe Derakshani
(74) *Attorney, Agent, or Firm*—Eugene Stephens & Associates; Eugene S. Stephens

(57) ABSTRACT

A disposable bag for a liquid shipping container has a multi ply region arranged to be inflated as the bag empties in such a way as to form a sump at the bag bottom for discharge of pumpable material from the sump.

20 Claims, 4 Drawing Sheets

DISCHARGE OF PUMPABLE MATERIAL FROM SHIPPER BAGS

RELATED APPLICATIONS

This application is a Continuation-In-Part of application Ser. No. 09/765,176 filed on Jan. 18, 2001, which in turn is a Continuation-In-Part Ser. No. 09/237,819, filed on Jan. 27, 1999 of U.S. Pat. No. 6,234,351, which patent claims the benefit of the filing dates of U.S. Provisional Application Nos. 60/072,815 and 60/072,816, both filed on Jan. 28, 1998. The disclosures of U.S. Pat. No. 6,234,351 and Continuation-In-Part co-pending application Ser. No. 09/765,176 are hereby incorporated by reference.

TECHNICAL FIELD

Discharge of pumpable material from plastic or flexible bags lining intermediate bulk material shipping containers.

BACKGROUND

As related in the background section of U.S. Pat. No. 6,234,351, many problems have interfered with full evacuation of pumpable or flowable bulk material contents from plastic bags lining intermediate bulk material shipping containers. These containers can be handled by forklifts and arranged conveniently in trucks, railroad cars, ships, or planes where each container holds typically around 300 gallons of flowable or pumpable bulk material contained within a plastic liner bag.

For several reasons the shipping container industry prefers that bottoms for such containers be flat. It also prefers to avoid the problems of tilting containers for discharge of their contents, elevating containers for this purpose, or requiring manual intervention to be sure that most of the shipped material is successfully discharged from each container. The full discharge of shipped material becomes especially problematic with highly viscous materials such as mayonnaise or dry wall paste, and with powdered or granular materials that are barely flowable or pumpable.

The aim of the inventions of U.S. Pat. No. 6,234,351, parent application Ser. No. 09/765,176 and this application, is to solve the problems of full content evacuation from bag-lined liquid shippers in an inexpensive, effective, and labor free way. To this purpose, the subject matter of this application adds to and refines similar subject matter previously disclosed in U.S. Pat. No. 6,234,351 and parent application Ser. No. 09/765,176.

SUMMARY

The present system of enhancing discharge of pumpable material from a liner bag of a liquid shipper uses a bag having an inflatable region formed of a pair of plies secured together to enclose an air containment region. This is preferably done without using any material additional to what is already committed to the structure of the bag itself. The securing of the bag plies is configured so that when the bag is disposed within a supporting container, the air containment region is disposed outside a material discharge zone arranged at the bottom of the bag. The inflatable air containment region may also extend above the bottom of the bag, providing this does not interfere with discharge of material from the bag.

As material discharges from the bag, a delivery system urges air into the air containment region. As the weight of material remaining in the bag permits, the air inflates the air containment region outside the discharge zone, and this inflates or plumps the air containment region outside the discharge zone. Plumping the bag effectively raises above the bottom of the container a ply of the bag contacting the material to form the bag into a sump shape at the discharge zone. Gravity then makes the material flow downward along the slope of the raised ply toward the sump in the discharge zone where the material is discharged from the bag. The discharge can occur via a gravity drain, a pumped drain, or a pumped discharge up through a top of the bag and above the top of the container.

DRAWINGS

In addition to FIGS. 1–36 of U.S. Pat. No. 6,234,351 and FIGS. 37–39 from application Ser. No. 09/765,176, this application includes FIGS. 1–13 that schematically illustrate aspects of the invention as follows.

FIG. 1 generally illustrates the combination of a supporting container with a liner bag configured according to the invention.

FIGS. 2 and 3 schematically show two of the many alternative ways of securing plies of a pillow bag together in a discharge region located at a bottom of a liner bag.

DETAILED DESCRIPTION

What follows explains the working of this invention in the light of an improved understanding of its operating principles, as derived from experience in practicing the invention. It includes some details not found in previous disclosures, while it also incorporates all the information contained in parent U.S. Pat. No. 6,234,351 and parent application Ser. No. 09/765,176 which explain many variations and alternatives that are available in practicing the invention. This disclosure also applies the invention to a pumped discharge, which can occur through either top or bottom discharge openings of a liquid shipping container. One advantage of a pumped or siphoned discharge from a top of the container is the avoidance of valved discharge openings near a bottom of the container, which can present problems of their own. The invention is not limited to a top discharge, but is based on material discharge principles that apply in removing pumpable material from both top and bottom discharges.

Figure 1:
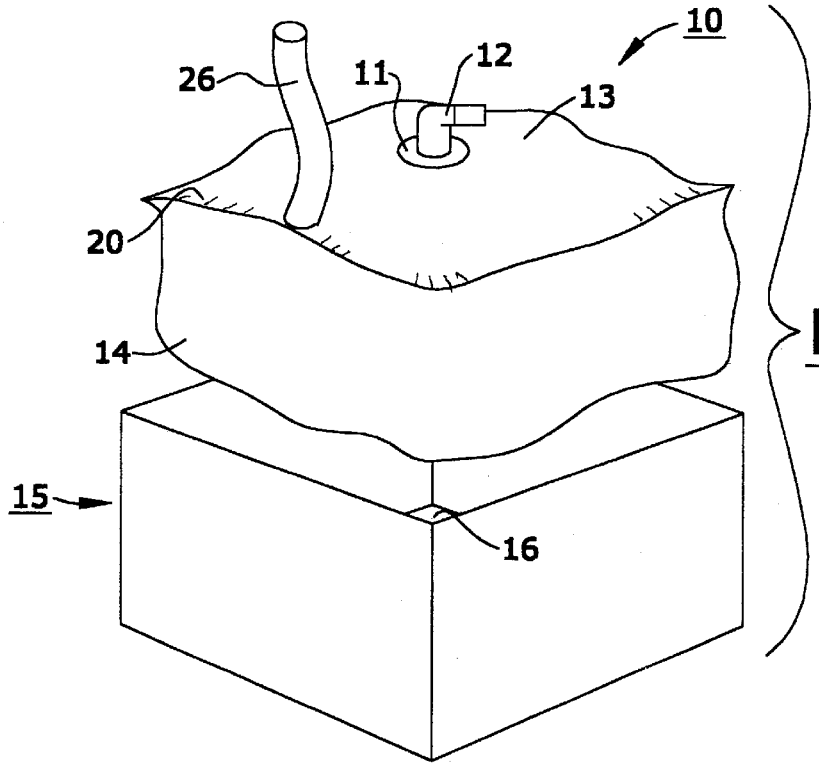

The exploded view of FIG. 1 schematically illustrates one of several preferred embodiments of the invention applied to a pillow type liner bag 10 arranged to hold pumpable material within supporting container 15. The invention can be practiced with both pillow bags, as illustrated, and with fitted bags, which are another general type of liner bag. Fitted bags are formed with gussets and seams necessary to give a liner bag the approximate shape of the supporting container in which it is arranged. Pillow bags are made flat, like unstuffed pillow cases, and are made larger than the supporting container so that the bag walls contain sufficient plastic to expand into the three dimensional space available within container 15 as it fills with pumpable material contained within bag 10. This necessarily involves some folds or tucks in the plastic material of the liner bag walls, since pillow bags are not made in the shape of their containers.

Both fitted and pillow bags are preferably filled through a top opening having an inflow fixture 11, which can advantageously be connected to an outflow fixture 12 for discharge of pumpable material through a top or upper region 13 of bag 10. Fixtures for top inflow and outflow can be arranged in many ways and have several advantages including avoiding an outflow opening in a lower region of container 15, avoiding a valve in such an outflow region, and thus avoiding accidental outflows from container 15.

A top outflow through discharge fixture 12 requires a pump or siphon capable of flowing material from within bag 10 to a level above the top of container 15. Such flow can be accomplished in many ways, including use of self-priming and positive displacement pumps.

Both fitted and pillow bags are typically made of two or more layers of plastic material. These layers are seamed together in various ways that are dictated by the construction of the bag. It is also possible to form these bags with single and multi-ply regions, such as single ply tops and multi-ply bottoms or sides. This invention recognizes that inexpensive variations in the way the bags are formed can greatly facilitate the removal of pumpable material from the bags.

As the material removed from the bag lowers to a few inches from the bottom of container 15, various occurrences can interfere with completing material removal. Plastic folds of a bag, for example, can clog a discharge conduit, or outflow can be interrupted by loosing suction from the low material level. A flat bottom of container 15 is typically about 16 square feet, and flowable material spread thin over such an area is difficult to drain out or pump out completely, especially if the liner bag bottom contains folds in the bag wall.

The invention solves these problems by providing a way of urging material in the bottom of bag 10 toward a discharge zone from which it can be pumped or drained so as to substantially empty bag 10 of its contents. This effect is achieved by inflating or plumping an intra ply region of bag 10 into a sump shape that urges the last of the material remaining in bag 10 toward the discharge zone. The invention accomplishes this by using low and inexpensive air pressure to plump a bag that is inexpensively seamed and arranged so that the bag plumping has the desired effect. It is also possible to use nitrogen or some other gas or fluid to plump a bag into the desired shape.

The inflating pressure used is preferably quite low and only slightly above atmospheric. The plumping pressure must not be forceful enough to burst the bag or its seams, and typically involves less than one PSIG. The inflating pressure can be increased if desired by making the bag strong enough to contain the inflating medium or by using the container and possibly a cover over the container to help contain the inflating pressure. "Low pressure" as used in the specification and claims thus refers to any pressure low enough to be contained within the bag and its container.

Considering the example of FIG. 1, pillow bag 10 is formed with a perimetal seam 20 that extends around an approximately equatorial periphery of bag 10. This separates a lower or bottom region 14 from top region 13 of bag 10. Such a seam 20 also insures that an inter ply region of bag bottom 14 is sealed closed so it can contain low-pressure air and can be plumped.

A passageway or conduit 26 allows low-pressure air to enter into a region between plies of bag bottom 14 where the air can inflate or plump bag bottom 14. Passageway 26 can be a simple plastic tube as illustrated, which is preferably incorporated into seam 20 without being seamed closed so as to conduct air into an inter ply region of bag bottom 14.

The most important region of bag 10 to be plumped for material discharge is the bag bottom region 14, at least a portion of which rests on a bottom 16 of container 15 to underlie the material held in bag 10. The separating and plumping of plies of bag bottom 14 as material is removed from bag 10 must effectively raise above container bottom 16 an inner ply of bag bottom 14 contacting material being removed from bag 10 so that gravity urges material downward along the slope of the raised inner ply toward a discharge region. This process is explained more fully below.

The inter ply air containment region of the bag must be arranged to form the desired sump configuration in the discharge zone when the bag is plumped with little material remaining in the bag for discharge. The preferred way of accomplishing this is with seams or bonds that secure together plies of the bag that are otherwise separated during bag plumping. It is also possible to plump the bag into the desired shape by using a weight or an external object such as a dip tube pressing downward on the bag in the discharge region where the sump shape is to be formed.

Many different shapes and locations of bag seams can make a bottom region of a fitted or pillow bag inflatable or plumpable. A seam effective for such purposes need not be an equatorial seam, and can be arranged anywhere from near the bottom to near the top of container 10. Plumping bag regions above container bottom 16 is acceptable so long as this does not interfere with discharge of contents from the bag. The bag plumping that facilitates material removal must extend to a bottom region of the bag, though, and the air containment configuration must make this possible.

There are also many ways of moving air into a sealed off inter ply bag region to accomplish the necessary bag plumping. Besides an inflow tube 26, such as illustrated in FIG. 1, valved or fixtured air openings can be seamed or sealed to a bag at appropriate locations.

What is essential is that an inexpensive and convenient means be arranged to admit low-pressure air, or some other gas or fluid, into the inflatable bag region that extends to the bag bottom, and that the air inflow passageway be accessible when needed during out flow of material from bag 10.

Figure 2:
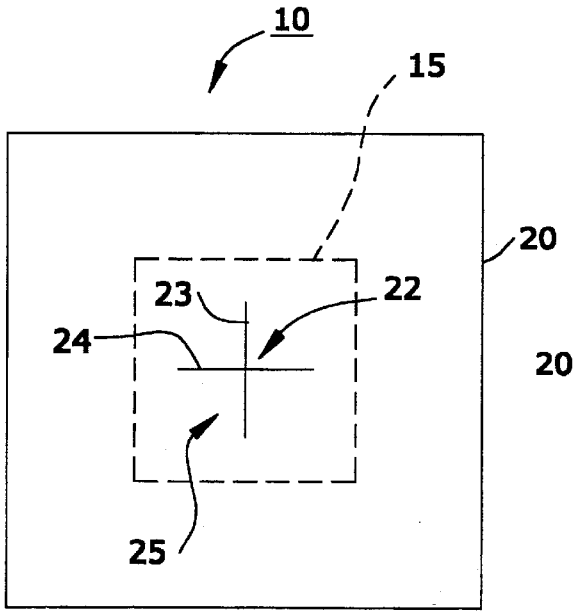
Figure 3:
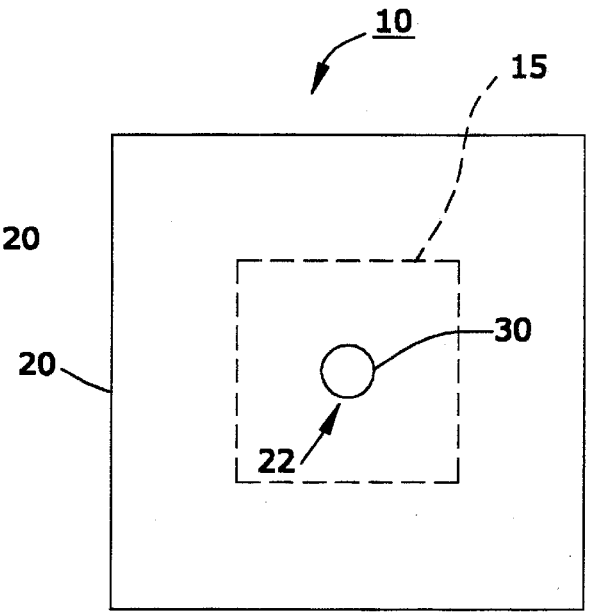

Besides providing a liner bag appropriately configured or seamed to be plumpable, the invention requires that a discharge region of the bag bottom not be plumped or inflated so that the discharge region remains as low as possible to receive material from surrounding regions for discharge from the bag. Two of the many possible solutions for this are schematically illustrated in FIGS. 2 and 3, and the way the plumping proceeds is schematically illustrated in FIGS. 4–10. FIGS. 2 and 3 both illustrate perimetal seams of pillow bag 10 being formed around a larger area than is occupied by container 15 so that bag 10 can be folded within container 15 and leave room to expand into a three dimensional shape when filled with material.

FIG. 2 generally shows one way to avoid plumping the discharge region by forming a seam in bag bottom 14 in a discharge region 22 so that the seam holds plies of the bag bottom together and prevents their separation from the air plumping effect. Bag bottom areas around the seam can then be plumped and inflated, but the seamed region of the bag remains uninflated and close to container bottom 16 to receive material for discharge. If bag 10 is made of more than two plies of material, preferably all the plies involved are secured together with whatever bottom seam configuration is chosen. Plumping can then occur in an inter ply region between two of the plies, with the bottom seam configuration insuring that none of the plies separate during plumping.

FIG. 2 also shows a bag bottom seam 25 in a preferred form of a pair of seam lines 23 and 24 crossing each other and extending toward sides of container 15. Seam lines 23 and 24 bond together plies of bag 10 and prevent any separation of the bag plies along the seam lines. When the bottom region of bag 10 is inflated, its bottom can plump inward from the corners of container 15, but its plies remain unplumped in the region of seam 25. This forms a sump shape that tends to flow undischarged material from the container corners inward toward the discharge region 22 where seam lines 23 and 24 cross each other.

Many other seam configurations can have a similar effect. Circular or curved seams can also hold bag plies together at the bag bottom and prevent their separation from inflating air. Optimizing a configuration of discharge region seams involves forming and orienting seams to co-operate effectively with bag plumping so as to guide undischarged material toward the discharge region. Effective seam shapes can surround or be spaced from a discharge zone, as well as extending into a discharge zone, and several examples of other effective seam configurations are shown in FIGS. 37A–F of parent application Ser. No. 09/765,176.

Another way of insuring that bag plumping forms the desired sump shape in bag bottom 14 is schematically shown in FIG. 3 as involving a dip tube 30 disposed in a discharge region of bag 10 to hold bag plies together in the discharge region 22 so that separation of bag plies from plumping is limited to bag bottom regions around dip tube 30. Such plumping then urges undischarged material toward dip tube 30 for discharge from bag 10. A dip tube 30 is preferably held down with sufficient force to ensure that the bottom of dip tube 30 remains at the bottom of the sump shape formed when plumping gives the bag walls sloping contact with the material being discharged. A dip tube 30 can also be arranged to co-operate with a seam configuration that insures that plumped elevation of an inner bag ply leaves a dip tube or drain is located at the bottom of the sump in the discharge zone. The sump that occurs from bag plumping and the location of the dip tube in the sump need not be centered in the bottom of the container. Also, it is possible for plumping to raise the sump above the bottom of the container, providing that the sump remains the lowest point that a bag surface contacts the material being discharged and the dip tube remains in the sump.

Figure 4:
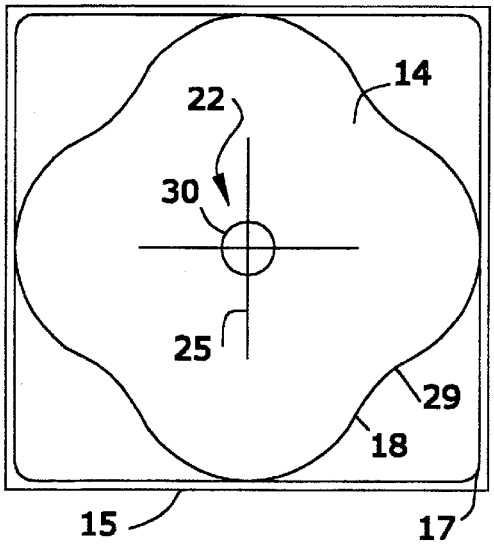
FIGS. 4–7 are schematic plan views of the bottom of a liner bag within a supporting container showing progressive plumping of a bottom region of a liner bag around a preferred form of a discharge zone to facilitate removing pumpable material from the bag.
Figure 5:
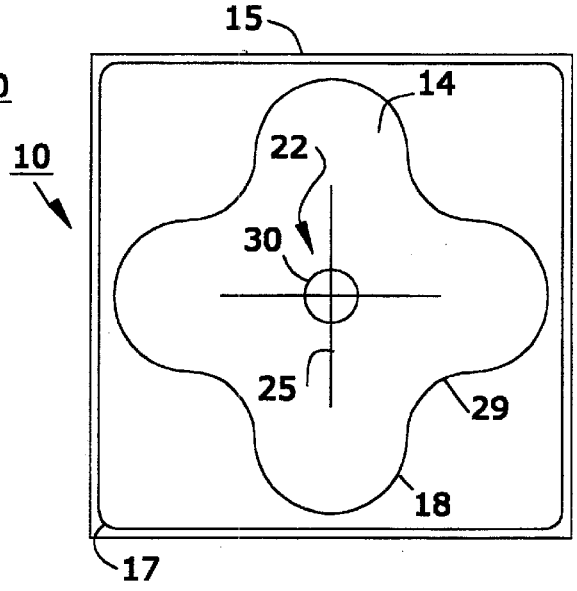

The effect of bag plumping according to the invention cannot ordinarily be observed directly, because it occurs in a bottom region of a liner bag within a container 15. Observations of this effect have been made using elevated containers with transparent bottoms showing what occurs as plumping of a bag bottom 14 urges material toward a discharge region 22. The results of these observations are illustrated schematically in FIGS. 4–10, using a bag 10 with a bottom seam 25 such as shown in FIG. 4, where a dip tube 30 is located.

As material 40 discharges from bag 10 through dip tube 30, air is admitted to bag bottom 14 so that plumping or inflation of intra ply region 28 will occur when the level of material 40 becomes sufficiently low. Plumping air can be admitted to intra ply region 28 at the beginning of discharge of material 40, or at any time after material discharge has started. Premature plumping of bag 10 will not facilitate material discharge, but also will not hamper material discharge, so it may be convenient when setting up a bag for material discharge to direct plumping air into intra ply region 28 initially so that it works automatically when the level of material 40 is sufficiently low.

When this occurs, inflating fluid in intra ply region 28 between an inner ply 18 contacting material 40 and an outer ply 17 contacting container 15 can begin to separate plies 17 and 18 to inflate or plump the bag bottom 14. When three or more plies are used to form bag 10, any extra ply is preferably disposed between plumped ply 18 and contents 40, but for simplicity of illustration, bag 10 is shown as formed of only two plies 17 and 18. Separation of inner ply 18 from outer ply 17 tends to lift inner ply 18, especially in corner regions of container 15. As inner ply 18 lifts away from outer ply 17, it forms an incline 29 around its engagement with pumpable material 40, which tends to flow or slide material 40 down incline 29 toward discharge region 22.

Figure 6:
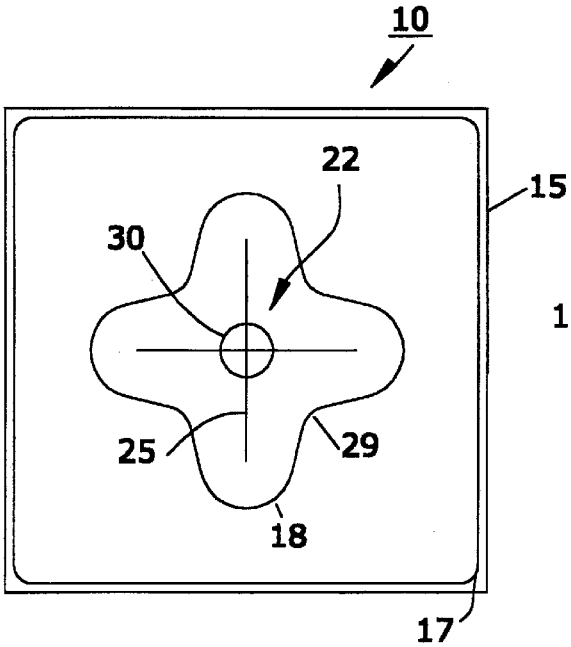
Figure 7:
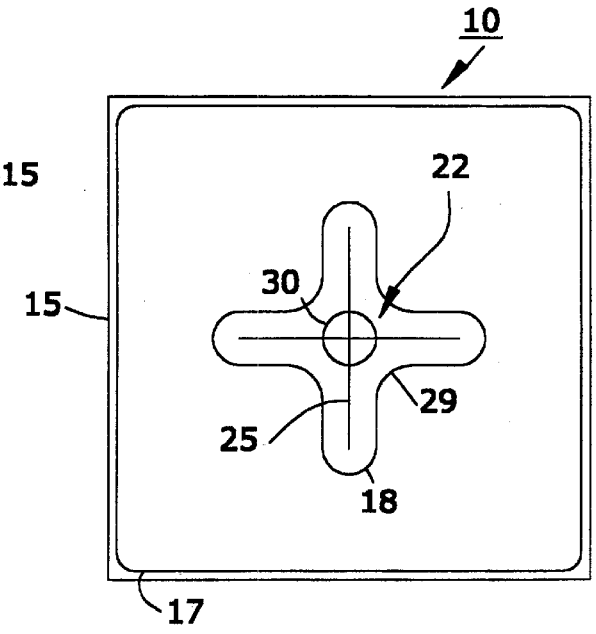
Figure 8:
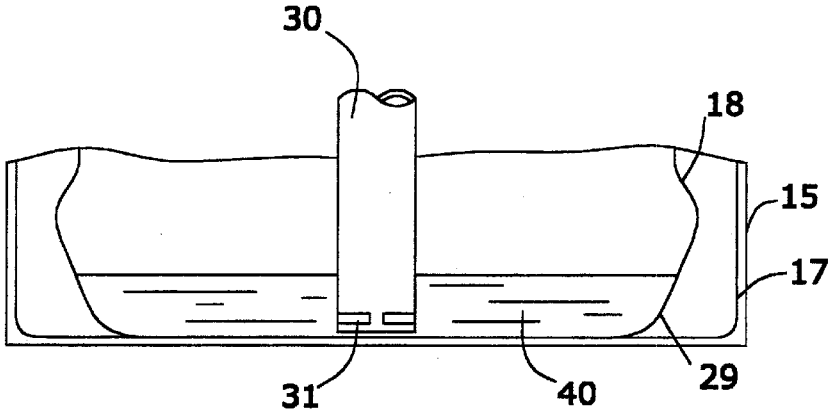
FIGS. 8–10 are schematic elevational views illustrating how plumping a liner bag according to the invention progressively raises above a discharge zone a ply of a bag contacting material within the bag to urge the material toward the discharge zone for discharge from the bag.
Figure 9:
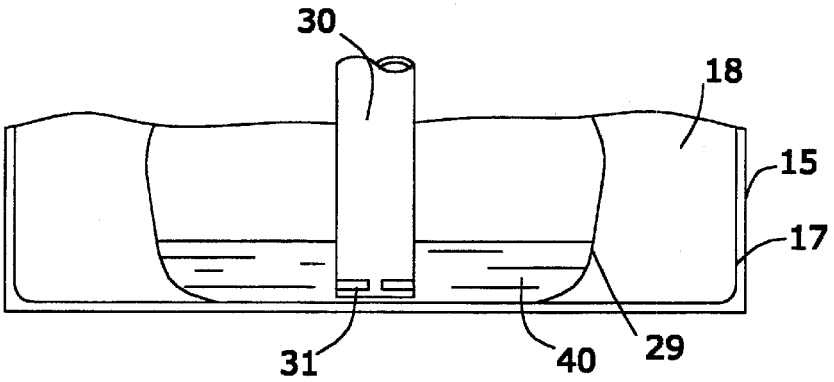
Figure 10:
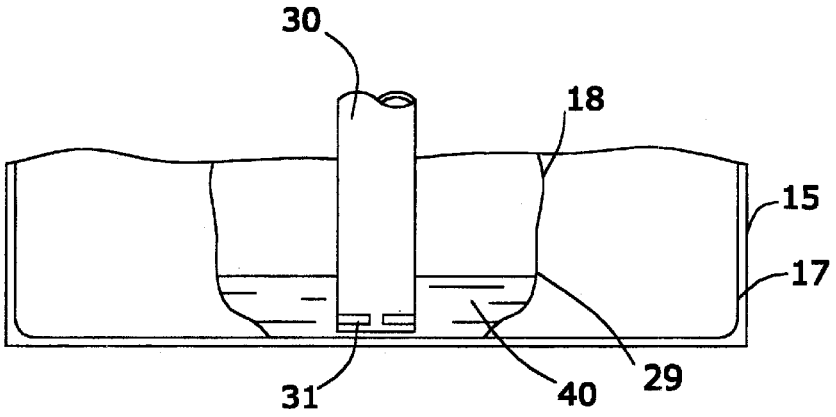

The preferred effect, as shown in FIGS. 4–10 is for the lifting of inner ply 18 away from outer ply 17 on container bottom 16 to advance steadily inward from corners of container 15, as permitted by the diminishing mass of material 40, as best shown in FIGS. 4–7. Cross seam 25 prevents separation of plies 17 and 18 along approaches to discharge region 22 and thereby prevents any plumping along the lines of seam 25, as best shown in FIGS. 6 and 7. This tends to form seam lines 25 into channels or valleys along which material 40 can proceed toward discharge region 22, which becomes a sump surrounded by the elevation of bag ply 18.

The plumped up elevation 29 of inner ply 18 engaging material 40 thus slides or flows material 40 steadily inward from the corners of container 15 toward the sump in discharge region 22 where dip tube 30 is arranged. The plumping process thus ensures that openings 31 into dip tube 30 are kept flooded with material 40, which then discharges through tube 30. The plumping of intra ply region 28 also tends to remove or straighten out wrinkles or folds in bag bottom 14 and prevents any such folds from interfering with discharge tube 30. This action also stretches bag material taught so that a bag surface does not bend around or obstruct side ports near the lower end of the dip tube. The presence of a discharge region seam 25 facilitates material discharge by providing unplumped grooves leading toward discharge region 22. As the plumping proceeds toward the nearly final result schematically shown in FIGS. 7 and 10, material 40 is channeled along seam lines 25 and concentrated in what is left of discharge region 22 around dip tube 30 for discharge.

As explained relative to FIG. 3, it is also possible for dip tube 30 to provide a means for holding bag plies 17 and 18 together in discharge region 22. A dip tube 30 pressing down against bag bottom 14 may be all that is required for effective plumping of the bottom of a fitted bag, for example. For pillow bags, though, we prefer a seamed configuration preventing bag ply separation in discharge region 22. Although bag plumping is schematically illustrated in FIGS. 4–10 for discharge through dip tube 30, a discharge can also occur through a drain arranged at box bottom 16. A discharge region also need not be arranged in the center of bag bottom 14 and container bottom 16, and either dip tubes or drains can be arranged along sides or edges of container bottom 16.

Fitted bags normally have cross seams at their tops and bottoms, which may make any additional seaming unnecessary to practice the invention. If an inter ply region of a fitted bag is plumped, this tends to inflate the top of the bag first, which may be acceptable, providing discharge from the bag is arranged so that such plumping does not interfere. A fitted bag can also be seamed to confine a bag plumping region to lower sides and bottom of the bag. As bag plumping proceeds with material nearly discharged from a fitted bag, its corner edges tend to inflate inwardly. This plumping effect forms the bottom of a fitted bag into a central sump where a dip tube or drain can be located for full discharge of the bag contents.

Figure 11:
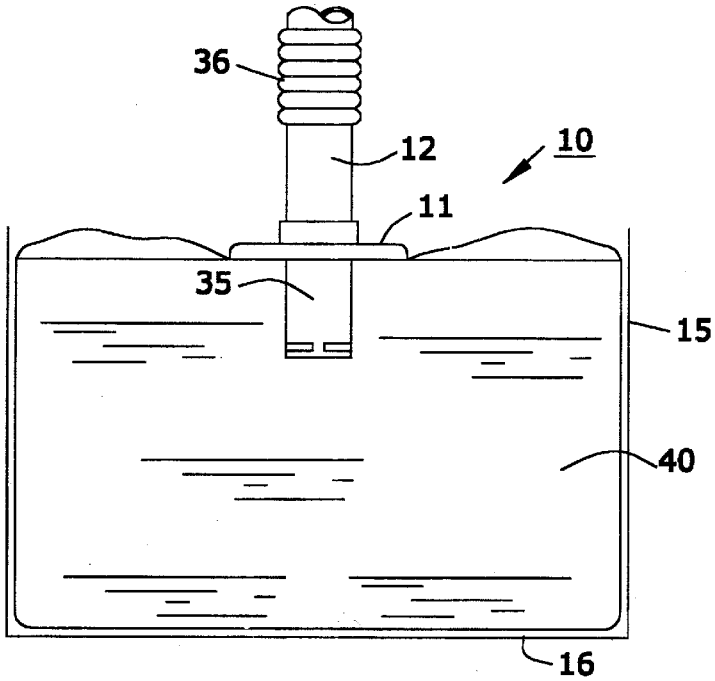
FIGS. 11–13 are schematic elevational views of a discharge fixture through which material is pumped from a liner bag so that the discharge fixture progressively descends toward a discharge zone of the bag as material is pumped from the bag.
Figure 12:
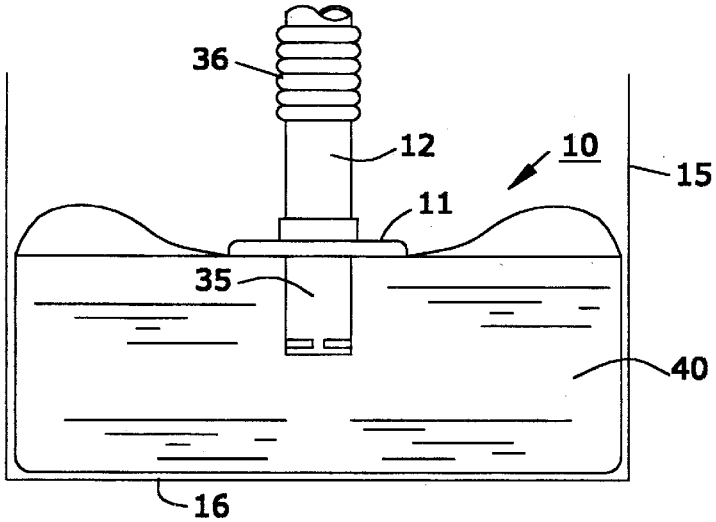
Figure 13:
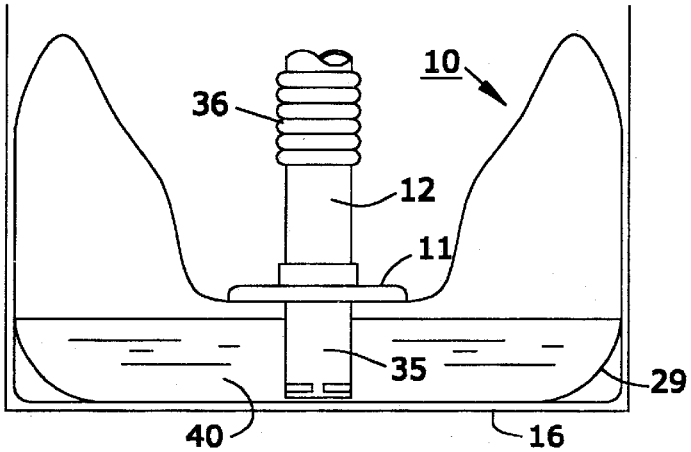

FIGS. 11–13 schematically show discharge through a dip tube 35 that does not extend initially to container bottom 16. A relatively short dip tube 35 can extend below fixture 11 at the top of bag 10 so long as a flexible connection 36 extends from discharge or outflow fixture 12. The assembly of dip tube 35, fixtures 11 and 12, and flexible outflow line 36, can then descend within container 15 as material level 40 lowers through the depths shown progressively in FIGS. 11–13. When the level of material 40 is low enough for bag plumping action to begin changing the shape of bag bottom 14, as shown in FIG. 13, then dip tube 35 has lowered sufficiently to reach container bottom 16 in discharge region 22. The plumping of bag 10 is arranged to form a sump at the lower most location of dip tube 35. This preferably occurs at container bottom 16, when material is nearly completely discharged from bag 10. It is possible for plumping to raise the sump formed by bag bottom 14 above container bottom 16, while lifting the bottom of dip tube 35 somewhat. This is satisfactory, so long as the sump formed by the plumping action remains the lowest point of bag bottom 14 at the location of dip tube 35.

Using a shorter dip tube 35, as shown in FIGS. 11–13, has the advantage of visibly indicating the level of material 40 in container 15, because fixture 11, which is visible from the top of container 15 effectively floats on the upper surface of material 40. A shorter dip tube 35 also saves the expense of a longer one, while ensuring, in co-operation with the bag plumping process, that a lower end of dip tube 35 reaches bag bottom 14 when the level of material 40 allows the plumping process to begin. This then urges material 40 into the sump at discharge region 22 around dip tube 35.

Discharge of highly viscous materials 40 can also benefit from a shorter dip tube 35. This can make pump priming easier, can increase a pumped flow rate, and can better accommodate positive displacement pumping systems such as an augur discharge arranged within a short dip tube 35.

A shorter dip tube can be made inexpensively enough to be disposable. This can eliminate any need to clean a previously used dip tube, and a disposable dip tube can be especially valuable for discharging material that must not be contaminated. A disposable dip tube, preferably made of sterilized plastic, can be packaged in with the disposable bag before it is filled, and because of its small size and expense, such a disposable dip tube can be deployed for discharge of material from the bag without risk of contamination.

We claim:

1. A system of enhancing discharge of pumpable material from a material discharge zone disposed at a bottom of a disposable plastic bag arranged within a supporting container so that a bottom of the bag contacts a bottom of the container and underlies material contained in the bag, the system comprising:

a. at least a portion of the bag being formed of multiple plies secured together in a configuration that confines inflating air within an inflatable region between the secured together plies;

b. the ply securing configuration being arranged to dispose the inflatable region outside the discharge zone at the bottom of the bag;

c. an air delivery system arranged to urge air into the inflatable region when the bag is disposed in a container and at least partly filled with the material; and d. the ply securing configuration being arranged so that the air plumps the inflatable region of the bag and, as weight of the material remaining in the bag permits, raises above the bottom of the container a ply of the bag contacting the material whereupon gravity makes the material flow downward along a slope of the raised ply into the sump in the discharge zone where the material is discharged from the bag.

2. The system of claim 1 including a dip tube holding the material-contacting bag ply down in a bottom region of the sump in the discharge zone.

3. The system of claim 1, wherein the ply securing configuration includes a cross seam centered in the discharge zone and extending from the discharge zone toward sides of the container.

4. The system of claim 1 including a fixture supporting a conduit for pumped outflow of material from the sump.

5. The system of claim 4 wherein the fixture is arranged to descend toward the discharge zone as material is pumped from the bag.

6. A disposable, multi-ply plastic bag structured to facilitate outflow of material from a discharge zone of the bag disposed at a bottom of the bag when the bag is arranged within a supporting container, the bag comprising:

a. at least a portion of the bag being formed of multiple plies secured to each other so as to contain air in an air containment region;

b. the air containment region being arranged to extend at least partly over the bottom of the bag;

c. an air passageway arranged to conduct inflating air into the air containment region;

d. plies of the bag forming the air containment region being arranged in the discharge zone at the bottom of the bag to limit inflation of the air containment region from air delivered through the air passageway to a region spaced from the discharge zone; and e. the air containment region of the bag being configured so that inflation of the air containment region as the material is flowed from the bag causes a bag surface contacting the material to elevate above the discharge zone in regions of the bag spaced from the discharge zone to shape the bag surface into a sump located in the discharge zone so that gravity urges the material down a slope of the elevated bag surface and into the sump at the discharge zone for discharge from the bag.

7. The bag of claim 6 wherein the air containment region is formed by seaming together plies of the bag.

8. The bag of claim 7 wherein the seaming together of the plies of the bag includes a pair of seam lines crossing in the discharge zone and extending toward sides of the bag.

9. The bag of claim 6 including a discharge fixture arranged in a top of the bag to support a conduit through which the material is discharged from the bag.

10. The bag of claim 6 wherein the air passageway is a tube seamed to at least one of the bag plies.

11. A method of discharging pumpable material from a disposable multi-ply plastic bag supported within a shipping container, the method comprising:

a. pre-forming a continuous seam sealing together plies of the bag between which air can be contained;

b. pre-locating the continuous seam so that an interply air containment region within the seam extends over a bottom region of the bag supported by the container and extending under the material contained within the bag;

c. holding together plies of the bag forming the air containment region in a discharge zone disposed at the bottom of the bag;

d. urging air into the air containment region when a major portion of the material has been discharged from the bag to inflate the air containment region of the bag outside the discharge zone where the plies of the bag are held together; and e. using inflation of the air containment region to cause a ply of the bag contacting the material within the bag to elevate above the discharge zone so that gravity urges the material downward along the elevated ply of the bag toward the discharge zone where the material is discharged from the bag.

12. The method of claim 11 including using a dip tube to hold together the plies of the bag in the discharge zone.

13. The method of claim 11 including pumping material from the bag through a discharge fixture secured to a top of the bag and allowing the discharge fixture to move downward within the container toward the discharge zone as material is pumped from the bag.

14. The method of claim 11 including pre-forming a seam between plies of the bag to hold together the plies of the bag in the discharge zone.

15. A system of enhancing discharge of pumpable material from a disposable, multi-ply, plastic pillow bag containing the material within a supporting container, the system comprising:

a. plies of the bag being seamed together in a bottom seam disposed in a discharge zone and in a perimital seam that confines inflating air within an inflatable region arranged to extend into a bottom portion of the bag outside the bottom seam so that low pressure air pumped into the inflatable region can plump the bag below the perimital seam and around the bottom seam; and b. an air delivery system arranged to urge low pressure air into the inflatable region when the bag is disposed in the container and at least partially filled with the material so that as weight of the material remaining in the bag permits, the delivered air separates the bag plies in regions away from the seams to raise above the bottom of the container a ply of the bag contacting the material so that gravity makes the material flow downward along the raised ply toward the discharge zone where the material is discharged from the bag.

16. The discharge system of claim 15 wherein the air delivery system includes a plastic air tube seamed to at least one of the bag plies.

17. The discharge system of claim 15 wherein the bottom seam is configured as a cross.

18. The discharge system of claim 15 wherein the bag is a pillow bag and the perimetal seam is arranged approximately at an equator of the bag.

19. The discharge system of claim 15 including a material pumping system arranged for pumping the material up through a top of the bag.

20. The discharge system of claim 19 including a material outflow discharge fixture arranged at the top of the bag and allowed to descend toward the discharge zone as material is pumped out of the bag.

* * * * *